US008485683B2

(12) United States Patent
Popper et al.

(10) Patent No.: US 8,485,683 B2
(45) Date of Patent: Jul. 16, 2013

(54) FLASHLIGHT WITH LIGHT FOCUSING SYSTEM

(75) Inventors: Richard S. Popper, Scottsdale, AZ (US); Jensen Jorgensen, Scottsdale, AZ (US)

(73) Assignee: XGlow P/T, LLC, Scottsdale, AZ (US)

( * ) Notice: Subject to any disclaimer, the term of this patent is extended or adjusted under 35 U.S.C. 154(b) by 0 days.

(21) Appl. No.: 13/570,095

(22) Filed: Aug. 8, 2012

(65) Prior Publication Data

US 2012/0300442 A1 Nov. 29, 2012

Related U.S. Application Data

(63) Continuation-in-part of application No. 13/403,395, filed on Feb. 23, 2012.

(60) Provisional application No. 61/446,527, filed on Feb. 25, 2011.

(51) Int. Cl.
*F21L 4/00* (2006.01)

(52) U.S. Cl.
USPC ..... 362/188; 362/187; 362/285

(58) Field of Classification Search
USPC ..... 362/187–188, 285
See application file for complete search history.

(56) References Cited

U.S. PATENT DOCUMENTS

| | | | | |
|---|---|---|---|---|
| 1,442,903 | A | 1/1923 | Paine | |
| 1,669,292 | A | 5/1928 | Eckstein | |
| 1,674,650 | A | 6/1928 | Leser | |
| 2,124,153 | A | 7/1938 | Scholtes | |
| 2,125,038 | A | 7/1938 | Tompkins et al. | |
| 3,603,783 | A | 9/1971 | Schwartz | |
| 4,398,238 | A | 8/1983 | Nelson | |
| 4,987,523 | A | 1/1991 | Lindabury et al. | |
| 5,171,086 | A | 12/1992 | Baloochi | |
| 5,826,971 | A * | 10/1998 | Kibler | 362/188 |
| 6,004,008 | A | 12/1999 | Lai | |
| 6,547,414 | B2 | 4/2003 | Steger | |
| 6,726,342 | B1 | 4/2004 | Lai | |
| 6,877,876 | B1 | 4/2005 | Steinhilber | |
| 7,344,269 | B2 | 3/2008 | Maglica | |
| 8,152,327 | B2 * | 4/2012 | Brands et al. | 362/187 |

* cited by examiner

*Primary Examiner* — Diane Lee
*Assistant Examiner* — Sean Gramling
(74) *Attorney, Agent, or Firm* — Stephen C. Beuerle; Procopio Cory Hargreaves & Savitch LLP

(57) ABSTRACT

A flashlight includes a housing including a hollow interior bound by a chamber wall having opposed inner and outer surfaces; a lens carried by the housing opposing the hollow interior; a light source supported by a movable light source support in the hollow interior; and a focusing assembly for moving the light source relative to the lens in a longitudinal motion comprising an external movable element movably arranged on the outer surface of the chamber wall and coupled with the light source support in the hollow interior for movement with the external movable element.

9 Claims, 5 Drawing Sheets

FLASHLIGHT WITH LIGHT FOCUSING SYSTEM

CROSS-REFERENCE TO RELATED APPLICATIONS

This application is a continuation-in-part of U.S. patent application Ser. No. 13/403,395, filed on Feb. 23, 2012, and claims priority to U.S. Provisional Patent Application No. 61/446,527 filed Feb. 25, 2011. All of the above patent applications are incorporated by reference herein as though set forth in full.

TECHNICAL FIELD

The present invention relates to flashlights and, more particularly, to flashlights with light focusing systems.

BACKGROUND ART

Some flashlights that use light-emitting diode (LED) light sources are configured with light-focusing mechanisms. However, these flashlights have drawbacks due to their focusing mechanisms that weaken the overall flashlight. For example, exemplary prior art light focusing flashlights include a head or head part that is moved relative to the main flashlight body by a twisting motion, which requires the use of two hands to perform the focus change, which makes the flashlight cumbersome and inconvenient. Furthermore, the movement of the head part or similar results in a flashlight which is more vulnerable to physical wear and tear and which is less resistant to rain, dust, saltwater and other elements than an ordinary flashlight. This is due to the fact that it is a main part of the flashlight housing which forms the actuating part in the focusing mechanisms, and hereby the focusing mechanism and flashlight as whole may potentially not be sealed sufficiently to eliminate the effect of such elements which may cause unsatisfactory long term issues.

Thus, there is a need in the art for a flashlight with a focusing mechanism that allows for the change of focus of the light without jeopardizing the durability of the structure and the resistance of the flashlight to moisture, dust, saltwater, mud, and other caustic or otherwise harmful elements.

SUMMARY OF THE INVENTION

According to the principle of the invention, a flashlight includes a housing having a hollow interior bound by a chamber wall having opposed inner and outer surfaces, a lens carried by the housing opposing the hollow interior, a light source supported by a light source support in the hollow interior, and a focusing assembly for moving the light source relative to the lens in a longitudinal motion including a button slidably arranged on the outer surface of the chamber wall in magnetic communication with an opposed sliding member connected to the light source support in the hollow interior and which is slidably arranged on the inner surface of the chamber wall. The light source is connected to an energy source carried by the housing with a flexible connection that yields between the energy source and the light source support in response to movement of the light source support with the focusing assembly. The flexible connection is a flexible wire in a preferred embodiment, and the energy source is a battery in a preferred embodiment. A slide assembly is coupled between the inner surface of the chamber wall and the sliding member for guiding the sliding member, and the light source is preferably at least one light-emitting diode.

According to the principle of the invention, a flashlight includes a housing having a hollow interior bound by a chamber wall having opposed inner and outer surfaces, a lens carried by the housing opposing the hollow interior, a light source supported by a light source support in the hollow interior, and a focusing system or assembly for moving the light source relative to the lens in a longitudinal motion including a slidably arranged button in direct sliding contact with the outer surface of the chamber wall in magnetic communication with an opposed slidably arranged sliding member connected to the light source support in the hollow interior and which is in direct sliding contact with the inner surface of the chamber wall. The light source is connected to an energy source carried by the housing with a flexible connection that yields between the energy source and the light source support in response to movement of the light source support with the focusing assembly. The flexible connection is a flexible wire in a preferred embodiment, and the energy source is a battery in a preferred embodiment. A slide assembly is coupled between the inner surface of the chamber wall and the sliding member for guiding the sliding member, and the light source is preferably at least one light-emitting diode.

According to the principle of the invention, a flashlight includes a housing having a hollow interior bound by a chamber wall having opposed inner and outer surfaces. A lens is carried by the housing and opposes the hollow interior. The flashlight additionally includes a light source supported by a light source located in the hollow interior. The flashlight further includes a focusing system or assembly for moving the light source relative to the lens in a longitudinal motion which includes a slidably arranged first magnet in direct sliding contact with the outer surface of the chamber wall in magnetic communication with an opposed slidably arranged second magnet connected to the light source support in the hollow interior and which is in direct sliding contact with the inner surface of the chamber wall. The light source is connected to an energy source carried by the housing with a flexible connection that yields between the energy source and the light source support in response to movement of the light source support with the focusing assembly. In a preferred embodiment, the flexible connection is a flexible wire. A slide assembly is coupled between the inner surface of the chamber wall and the second magnet for guiding the second magnet, and the light source is preferably at least one light-emitting diode.

Another aspect of the invention involves a flashlight including a housing including a hollow interior bound by a chamber wall having opposed inner and outer surfaces; a lens carried by the housing opposing the hollow interior; a light source supported by a movable light source support in the hollow interior; and a focusing assembly for moving the light source relative to the lens in a longitudinal motion comprising an external movable element movably arranged on the outer surface of the chamber wall and coupled with the light source support in the hollow interior for movement with the external movable element.

One or more implementations of the aspect of the invention immediately above includes one or more of the following: a mechanical connector couples the light source support with the external movable element; the mechanical connector is a connection rod; the light source support includes structural heat transfer features to enhance heat transfer therefrom; the light source support and the mechanical connector form a heat transfer mechanism that transfers heat away from the light source and light source support; the external movable element is an external focusing ring movably arranged on the outer surface of the chamber wall; the external focusing ring includes a top end and the flashlight includes an annular receiving section in the hollow interior a disposed radially outward from the lens, and the top end of the external focusing ring is movably disposed in the annular receiving section; the lens includes a rear hole, and the focusing assembly moves the light source within the rear hole of the lens in a longitudinal motion; the rear hole of the lens includes a frustoconical configuration; the flashlight includes a groove that the mechanical connector reciprocally slides within to enable the light source support to move with movement of the external movable element; one or more magnets couple the light source support with the external movable element; the focusing assembly includes an external movable element in direct sliding contact with the outer surface of the chamber wall in magnetic communication with an opposed slidably arranged sliding member coupled to the light source support in the hollow interior and which is in direct sliding contact with the inner surface of the chamber wall; the external movable element and sliding members are in direct radial alignment with each other; the light source support has a cup-shaped configuration; the opposed slidably arranged sliding member is fixed to the light source support whereby the light source support moves with the opposed slidably arranged sliding member; a slide assembly is coupled between the inner surface of the chamber wall and the sliding member for guiding the sliding member; the light source includes an energy source carried by the housing and light source is coupled to the energy source with a flexible connection that yields between the energy source and the light source support in response to movement of the light source support with the focusing assembly; the flexible connection is a flexible wire; and/or the light source comprises at least one light-emitting diode.

BRIEF DESCRIPTION OF THE DRAWINGS

Referring to the drawings.

DETAILED DESCRIPTION

Figure 1:
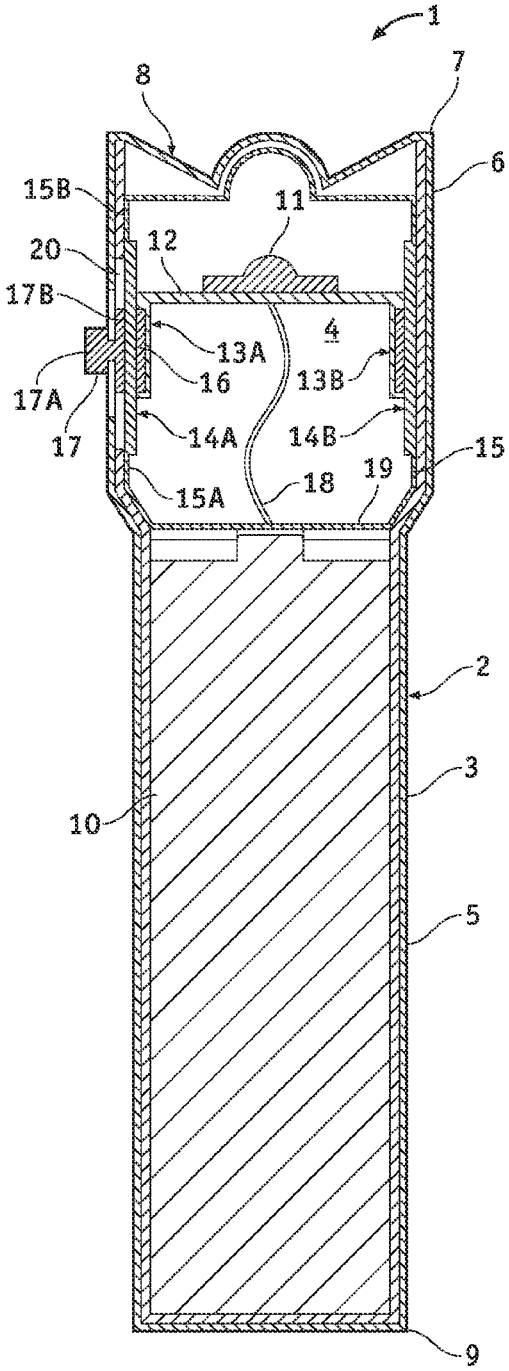
FIG. 1 is a schematic cross section of a flashlight constructed and arranged in accordance with the principle of the invention.
Figure 2:
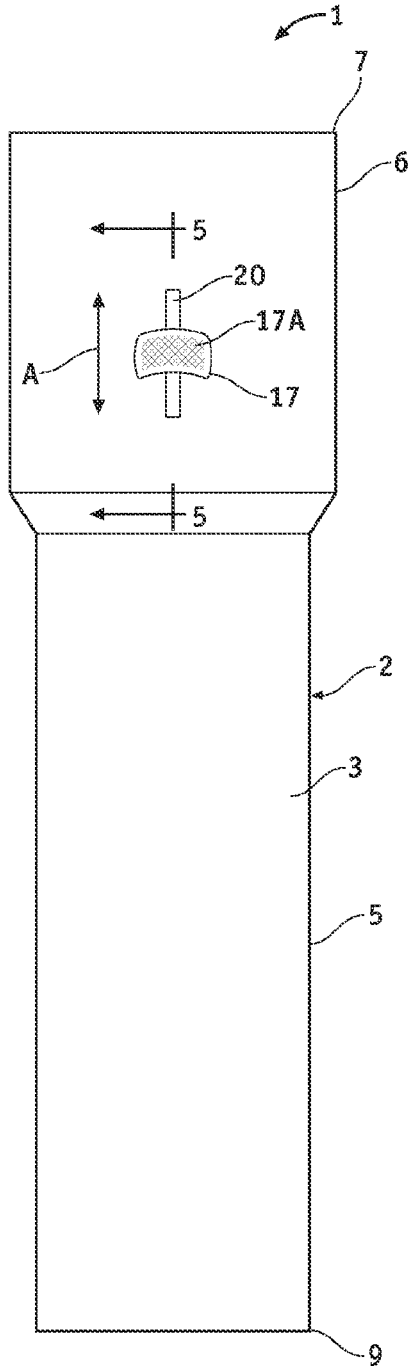
FIG. 2 is a side elevation view of the flashlight of FIG. 1 showing a flashlight housing with a button.

Turning now to the drawings, in which like reference characters indicate corresponding elements throughout the several views, attention is first directed to FIG. 1 and in relevant part to FIG. 2 in which there is illustrated a flashlight 1 constructed and arranged in accordance with the principle of the invention including a substantially cylindrical housing 2 with an outer side or surface 3, a hollow chamber or interior 4, a body or body part 5, and an opposed head or head part 6. In the present embodiment, head part 6 and body part 5 are cast in one piece. Housing 2 has opposed first and second ends 7 and 9. First end 7 is part of the head or head part 6, and second end 9 is part of the body or body part 5. At a first end 7 of housing 2 there is a lens 8. Lens 8 in the present example is fixed relatively to housing 2 and can, for example, be glued, welded or otherwise sealed and fixed in first end 7 of housing 2. Second end 9 may be fitted with electrodes (not shown) to enable recharging of a battery 10 located in hollow interior 4 of body part 5 of housing 2. Second end 9 can also be fitted with a mechanism for turning flashlight 1 ON and OFF.

Head part 6 of hollow interior 4 of housing 2 contains a light assembly consisting of a light source 11 arranged on and carried by a light source support 12. Light source support 12 is a circuit board that controls light source 11. Flashlight 1 is fashioned with a focusing system or assembly for moving light 11 source relatively to lens 8 in a longitudinal motion or otherwise in reciprocal backwards and forward directions with respect to lens 8. Light source support 12 is connected to opposed identical inner sliding members denoted generally at 13A and 13B, respectively, which form part of the focusing assembly of flashlight 1. Sliding members 13A and 13B are part of light source support 12 and are slidably arranged in that they are engaged in corresponding identical slide assemblies 14A and 14B formed between sliding members 13A and 13B and a chamber wall 15 of hollow interior 4 of head part 6. Sliding members 13A and 13B are identical, and only the specific details of sliding member 13A are discussed in the detail below with the understanding that the ensuing discussion of sliding member 13A applies in every respect to sliding member 13B. Slide assemblies 14A and 14B are also identical, and only the details of slide assembly 14A will be discussed with the understanding that the discussion below of slide assembly 14A applies in every respect to slide assembly 14B.

Chamber wall 15 of head part 6 is part of housing 2, and has an inner surface 15A facing hollow interior 4 and an opposed outer surface 15B. Slide assemblies 14A and 14B are positioned between chamber wall 15 and sliding members 13A and 13B, respectively, and sliding members 13A and 13B of light source support 12 are slidably arranged on inner surface 15A of chamber wall 15 with slide assemblies 14A and 14B in this preferred embodiment. In the present embodiment of flashlight 1, at least a part of inner sliding member 13A is a magnet 16. In flashlight 1, magnet 16 is in magnetic communication with an opposed outer button 17. Because at least a part of sliding 30 member 13A is magnet 16 and because magnet 16 is a part of sliding member 13A, sliding member 13A is in magnetic communication with button 17. Button 17 is a magnet, and is slidably arranged on outer surface 3 of flashlight 1. Hollow interior further includes a flexible connection or connector 18 for providing electrical contact between light source 11 and battery 10 via a connector plate 19 arranged about battery 10. Connector plate 19 is a circuit board in a preferred embodiment, and flexible connector 18 extends between and is electrically connected between, on the one hand, light source 11 and light source support 12, and, on the other hand, connector plate 19. Light source 11 is connected to the battery 10 energy source carried by housing 2 with flexible connection or connector 18 that, according to the invention, yields between the energy source formed by battery 10 in the preferred embodiment and light source support 12 in response to movement of light source support 12 with the focusing assembly of flashlight 1.

FIG. 2 shows flashlight 1 and button 17 as known from flashlight 1 in FIG. 1. Button 17 is received in and engages and is held by a button guide 20 formed in or otherwise embedded in outer surface 3. Button guide 20 is a slotted channel that is formed in housing 2 between outer surface 3 of housing 2 and outer surface 15B of chamber wall 15 of housing 2, and button 17 is received by the slotted channel forming button guide 20, and button guide 20 allows button 17 to be moved in a reciprocal directions relative to lens 8 and first end 7, which is a linear motion of button 17 backwards and forwards relatively to first end 7 and lens 8 along an axis parallel to the longitudinal direction of substantially cylindrical housing 2. The backwards/forward motion of button 17 is indicated by double arrowed line A in FIG. 2. When button 17 is moved as indicated by arrowed line A light source 11 and light source support 12 in hollow interior 4 will together move in a corresponding motion as the magnetic interaction between button 17 and magnet 16 of the inner sliding member 13A of light source support 12 forces the parts to move concurrently together, according to the principle of the invention. When light source 11 this way is moved relatively to lens 8 the focus and light cone through lens 8 of flashlight 1 will change correspondingly.

Figure 5:
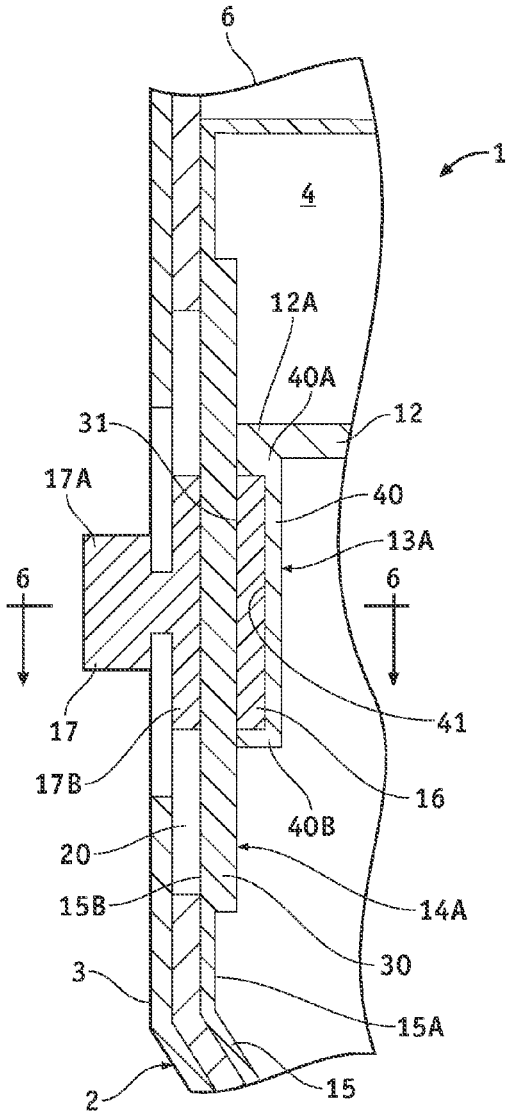
FIG. 5 is a section view taken along line 5-5 of FIG. 2.
Figure 6:
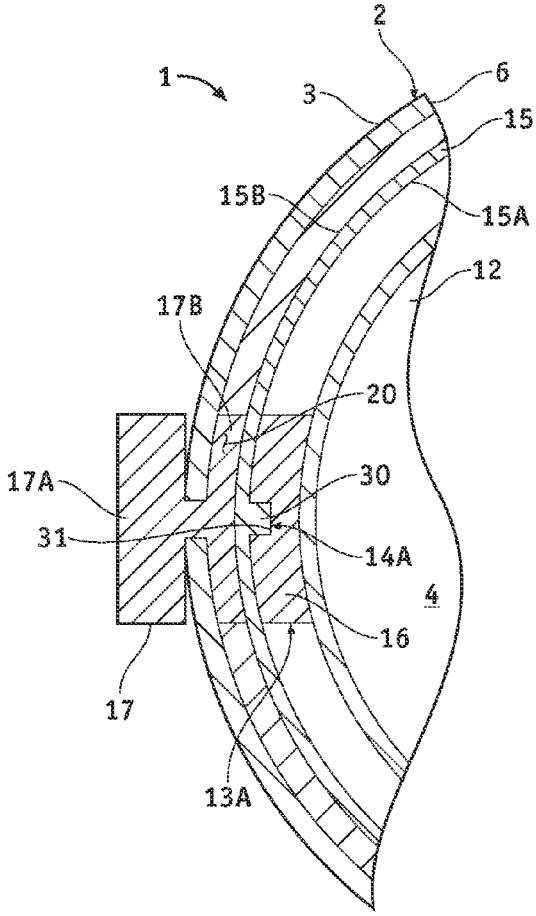
FIG. 6 is a section view taken along line 6-6 of FIG. 5.

Looking to FIGS. 5 and 6, button 17 has an exterior part 17A received on and extending outwardly from outer surface 3 of housing 2 so as to be accessible for moving, such as by a thumb or other finger of the hand of a user gripping e.g. body part 5, and button 17 extends inwardly through outer surface 3 of housing 2 from exterior part 17A to an opposed inner part 17B located in button guide 20 in housing 2 which, as explained above, is a slotted channel. Inner part 17B of button 17 is received in and engages and is held by button guide 20. Exterior part 17A of button 17 is located exteriorly of housing 2 and is used to move button 17 backwards/forward, such as by a user's finger. Inner part 17B of button 17 is located interiorly of housing 2 and slides through button guide 20 when button 17 is moved backwards/forward. Inner part 17B of button 17 in button guide 20 is received in direct contact with outer surface 15B of chamber wall 15 of housing 2, and remains in direct contact with outer surface 15B of chamber wall 15 of housing 2 when stationary and also when button 15 is slid/moved backwards/forward as is indicated by double arrowed line A in FIG. 2. Inner part 17B of button 17 slides directly against and remains in direct contact with outer surface 15B of chamber wall 15 of housing 2 when button 17 is slid or otherwise moved backwards and forward.

Magnet 16 of sliding member 13A in hollow interior 4 opposes inner part 17B of button 17 and is in direct contact with inner surface 15A of chamber wall 15 of housing 2 opposing inner part 17B of button 17 in direct contact with outer surface 15B of chamber wall 15 of housing 2 thus magnetically coupling magnet 16 of sliding member 13A of light source support 12 to the inner part 17B of button 17 through chamber wall 15. Sliding members 13A and 13B engage slide assemblies 14A and 14B, respectively, and slide there along to permit light source support 12 and light source 11 carried by light source support 12 to move backwards/forwards relatively to lens 8 in response to the backwards/forward motion of button 17 as indicated by double arrowed line A in FIG. 2. The magnetic coupling between inner part 17B of button 17, in direct contact with outer surface 15B of chamber wall 15, and opposing magnet 16, in direct contact with inner surface 15A of chamber wall 15, of sliding member 13A causes the light assembly consisting of light source support 12 and light source 11 carried by light source support 12 to move backwards/forwards relatively to first end 7 of housing 2 and lens 8 in response to the backwards/forward motion of button 17, according to the principle of the invention. The application of inner part 17B of button 17 in direct contact with outer surface 15B of chamber wall 15 opposing magnet 16 in direct contact with inner surface 15A of chamber wall 15 ensures a magnetic coupling persists between button 17 and light source support 12 to provide a reliable and persistent magnetic coupling there between to provide the beneficial result of a persistent and concurrent backwards/forward movement of button 17 and light source 11 of light source support 12 relatively to lens 8.

Magnet 16 is received in direct contact with inner surface 15A of chamber wall 15 of housing 2, and remains in direct contact with inner surface 15A of chamber wall 15 of housing 2 when stationary and also when light source support 12 is moved backwards/forward with the backwards/forward motion of button 17 as is indicated by double arrowed line A in FIG. 2. Magnet 16 carried by light source support 12 slides directly against and remains in direct contact with inner surface 15A of chamber wall 15 of housing 2 when button 17 is moved backwards/forward. Thus according to the principle of the invention, the focusing assembly of flashlight 1 for moving light source 11 relative to lens 8 in a longitudinal motion, namely, backwards/forward relatively to lens 8, includes slidably arranged inner part 17B, which is a magnet, of button 17 in direct sliding contact with the outer surface 15B of chamber wall 15 in magnetic communication with opposed slidably arranged magnet 16 connected to light source support 12 in hollow interior 4 and which magnet 16 is in direct sliding contact with inner surface 15A of chamber wall 15. Sliding member 13B is identical to slide assembly 13A and functions in the same way except without the interaction with a magnet button as with sliding member 13A. However, sliding member 13B may be associated with a corresponding magnet button, such as button 17 or an extension of button 17 in alternate embodiments.

Looking to FIGS. 5 and 6 in relevant part, slide assembly 14A formed between sliding member 13A and inner surface 15A of chamber wall 15 of housing 2 in hollow interior 4 of head part 6 consists of a tongue and groove assembly including a tongue 20 30 and a corresponding groove 31, both of which are elongate and extend longitudinally along the longitudinal direction of flashlight 1 in hollow interior 4 of head part 6 and permit and guide the sliding backwards/forward motion of light source support 12 and thus light source 11 with respect to lens 8 in response to the backwards/forward motion of button 17 caused by the magnetic coupling between button 17 and sliding member 13A and, more specifically, between button 17 and magnet 16 of sliding member 13A. In the preferred embodiment, tongue 30 is formed in or otherwise with inner surface 15A of chamber wall of housing 1, and groove 31 is formed in sliding member 13A. Sliding member 13A consists of magnet 16 carried by a lug 40 connected to light source support 12. Light source support 12 has an outer or 30 distal marginal extremity 12A (FIG. 5) near inner surface 15A, and lug 40 has an upper part 40A attached to this marginal extremity 12A and depends from this marginal extremity 12A to a lower part 40B of lug 40. Lug 40 is preferably formed integrally with light source support 12, and in an alternate embodiment may be affixed to light source support 12 with adhesive, welding, etc. Lug 40 extends downwardly from light source support 12 to lower part 40B in a direction toward connector plate 19 referenced in FIGS. 1, 3, and 4, and confronts and is near inner surface 15A of chamber wall 15. Magnet 16 is positioned between lug 40 and inner surface 15A of chamber wall 15 and is fitted within a recess 41 formed in lug 40 between upper and lower parts 40A and 40B, and is held by lug 40 and is received in direct contact with inner surface 15A of chamber wall 15. Magnet 16 is press fit in recess 41, and may be additionally or optionally secured in place with adhesive, one or more rivets or other form of mechanical fastener, or the like, if so desired. Groove 31 is formed in sliding member 13A, in which groove 31 is formed in and extends through marginal extremity 12A of light source support 12 and then through upper part 40A of lug 40 and further through magnet 16 and finally through a lower part 40B of lug 40. Groove 31 accepts tongue 30, and is free to slide along tongue 30 in the backwards/forward motion of light source support 12 in response to the backwards/forward motion of button 17. Although in the preferred embodiment tongue 30 is formed in inner surface 15A of chamber wall of housing 1 and groove 31 is formed in sliding member 13A, groove 31 may be formed in inner surface 15A of chamber wall of housing 1, and tongue 31 may be formed with sliding member 13A.

Figure 3:
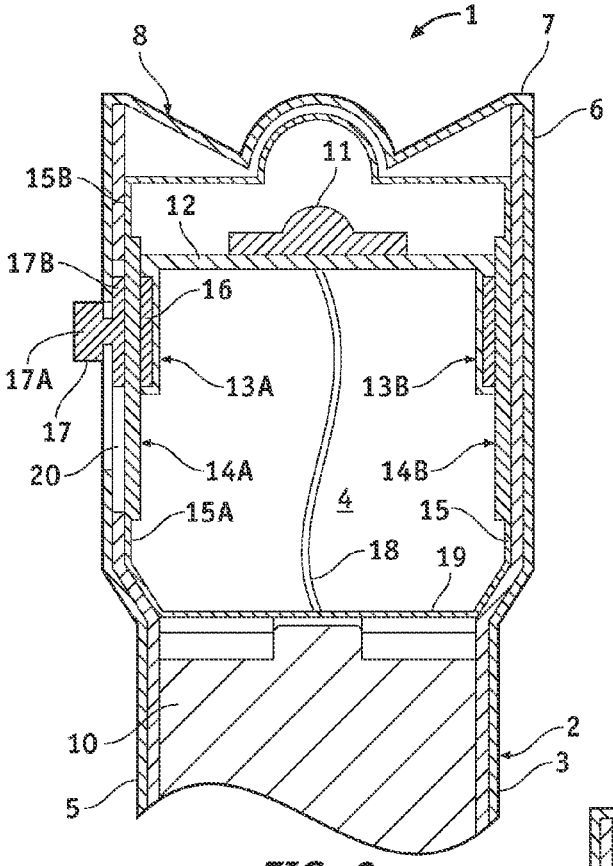
FIG. 3 is a fragmented section view of the flashlight of FIG. 1 illustrating the button moved toward a lens of the flashlight to achieve a first focus state of the flashlight.
Figure 4:
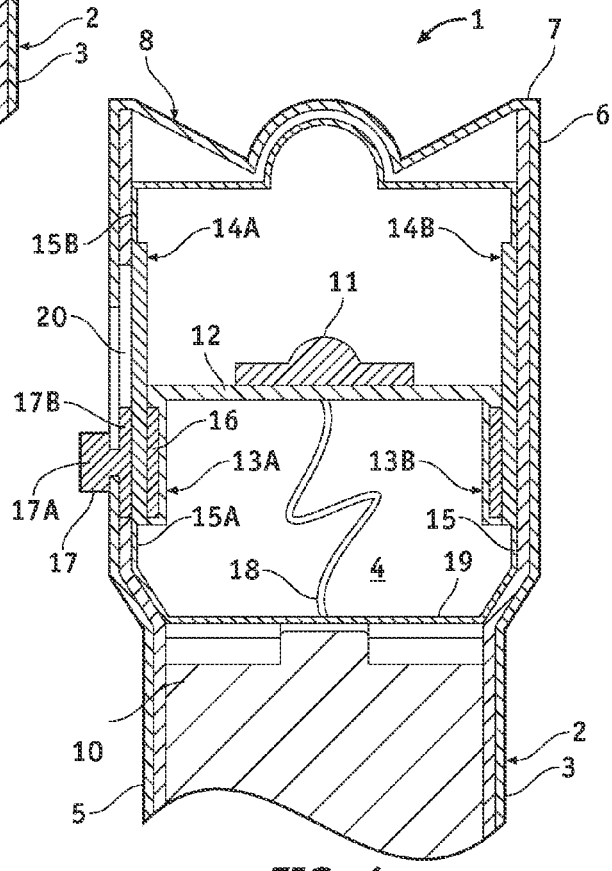
FIG. 4 is a view similar to that of FIG. 3 illustrating the button moved away from the lens of the flashlight to achieve a second focus state of the flashlight.

FIG. 3 is a fragmented section view of the flashlight 1 illustrating button 17 pushed in a direction towards lens 8 to move light source 11 close to lens 8 to achieve a first focus state of light generated by light source 11 of flashlight 1. FIG. 4 is a view similar to that of FIG. 3 illustrating button 17 pushed in a direction away from lens 8 to move light source 11 away from lens 8 to achieve a second focus state of light generated by light source 11 of flashlight 1. As a matter of example, the second focused state is a more narrowed focused state than the first focused state, and this is a function of lens 8 and the corresponding distances between lens 8 and light source 11.

According to the principle of the invention and referencing FIGS. 1-6 in relevant part, flashlight 1 includes housing 2 having hollow interior 4 bound by chamber wall 15 having opposed inner and outer surfaces 15A and 15B, a lens 8 carried by housing 2 opposing hollow interior 4, a light assembly in hollow interior 4 consisting of light source 11 supported by light source support 12, and a focusing assembly for moving light source 11 relative to lens 8 in a longitudinal motion including button 17 slidably arranged on outer surface 15B of chamber wall 15 in magnetic communication with opposed sliding member 13A connected to light source support 12 in hollow interior 4 and which is slidably arranged on inner surface 15A of chamber wall 15. Light source 11 is connected to an energy source carried by housing 2 with flexible connection or connector 18 that yields between the energy source and light source support 12 in response to movement of light source support 12 with the focusing assembly. The flexible connection 18 is a flexible wire in a preferred embodiment, and the energy source is battery 10 in a preferred embodiment. Slide assembly 14A is coupled between inner surface 15A of chamber wall 15 and sliding member 13A for guiding sliding member 13A, and light source 11 is preferably at least one light-emitting diode.

In another aspect according to the principle of the invention and again referencing FIGS. 1-6 in relevant part, flashlight 1 includes housing 2 having hollow interior 4 bound by chamber wall 15 having opposed inner and outer surfaces 15A and 15B, a lens 8 carried by housing 2 opposing hollow interior 4, a light assembly in hollow interior 4 consisting of light source 11 supported by light source support 12, and a focusing assembly for moving light source 11 relative to lens 8 in a longitudinal motion including slidably arranged button 17 in direct sliding contact with outer surface 15B of chamber wall 15 in magnetic communication with opposed slidably arranged sliding member 13A connected to light source support 12 in hollow interior 4 and which is in direct sliding contact with inner surface 15A of chamber wall 15. Light source 11 is connected to an energy source carried by housing 2 with flexible connection or connector 18 that yields between the energy source and light source support 12 in response to movement of light source support 12 with the focusing assembly. The flexible connection 18 is a flexible wire in a preferred embodiment, and the energy source is battery 10 in a preferred embodiment. Slide assembly 14A is coupled between inner surface 15A of chamber wall 15 and sliding member 13A for guiding sliding member 13A, and light source 11 is preferably at least one light emitting diode.

In yet another aspect according to the principle of the invention and yet again with reference to FIGS. 1-6 in relevant part, flashlight 1 includes housing 2 having hollow interior 4 bound by chamber wall 15 having opposed inner and outer surfaces 15A and 15B. Lens 8 is carried by housing 2 and opposes hollow interior 4. Flashlight additionally includes light source 11 supported by light source support 12 located in hollow interior 4. Flashlight 1 is formed with a focusing assembly for moving light source 11 relative to lens 8 in a longitudinal motion which includes a slidably arranged first magnet of button 17 in direct sliding contact with outer surface 15B of chamber wall 15 in magnetic communication with an opposed slidably arranged second magnet 16 connected to light source support 12 in hollow interior 4 and which is in direct sliding contact with inner surface 15A of chamber wall 15. Light source 11 is connected to an energy source carried by housing 2 with flexible connection or connector 18 that yields between the energy source and light source support 12 in response to movement of light source support 12 with the focusing assembly. In a preferred embodiment, flexible connection 18 is a flexible wire. Slide assembly 14A is coupled between inner surface 15A of chamber wall 15 and the second magnet 16 connected to light source support 12 for guiding the second magnet 16, and light source 11 is preferably at least one light-emitting diode.

With continuing referencing FIGS. 1-6 in relevant part, flashlight 1 is easy to use with one hand, is sturdy and highly durable, and is water and element resistant, and also preferably waterproof. These and other advantages are provided by the present invention in that flashlight 1 includes housing 2 having outer side or surface 3 and an at least a partly hollow chamber or interior, namely, the chamber or hollow interior 4. As described above, flashlight 1 has lens 8, light source 11 with light source support 12, and a focusing assembly for moving light source 11 relatively to lens 8 in a longitudinal motion, wherein the focusing assembly includes slidably arranged button 17 exteriorly of housing 2 or otherwise on the outer side of housing 2 in communication with inner sliding member 13A connected to light source support 12 in hollow interior 4. A flashlight arranged in this manner has an advantage that the moving parts mainly are inside hollow interior 4 and thus less liable to be impacted by dust, water, salt or freshwater, mud and other materials or particles which may damage the moveable parts or may obstruct the motion of the moveable parts i.e. inner sliding member 13A connected to light source support 12 in hollow interior 4. The moveable part found on outer surface 3 of housing 2 i.e. button 17 may be simple, and arranged in order to be easy to clean in order to avoid malfunction. Also the special focusing assembly leaves very limited or no access for e.g. dust or moisture from the outer side to any vital parts inside hollow interior 4. Such vital parts can be e.g. battery 10, circuit boards e.g. light source support 12 and connector plate 19 and/or wires e.g. connector 18.

The word "button" is in the present application used for an actuator which does not form a part of the actual flashlight housing. Button 17 may have a variety of shapes and sizes e.g. a simple rectangular shape or a curved shape fitting on or around part of housing 2 of flashlight 1.

Button 17 can be arranged to ensure a minimum of friction with the movement of button 17. Button 17 can also be arranged with one, two, three or more selected positions wherein button 17 may be locked relatively to housing 2 of flashlight 1 whereby the focus of flashlight 1 is locked.

When button 17 of flashlight 1 is moved backwards or forwards along the longitudinal direction of flashlight 1, inner sliding member 13A of light source support 12, and thus also inner sliding member 13B of light source support 12, will follow motion together with light source 11. The motion of light source 11 towards and away from lens 8 thus induced by the motion of button 17, changes the focus and/or angle of the light cone from flashlight 1. Thus, when a user slides button 17 in a direction away from lens 8, as in FIG. 4, light source 11 is moved away from lens 8 to achieve a focused state of the light generated by light source 11, and when the user slides button 17 in a motion in the direction towards lens 8, as in FIG. 3, light source 11 is moved towards lens 8 to achieve a different focused state of the light generated by light source 11.

Inner sliding members 13A and 13B are connected to light source support 12, and form an integral part of light source support 12 in a particular embodiment.

In a preferred embodiment, button 17 is a magnet and is in a magnetic communication/coupling with inner sliding member 13A. When button 17 on the outside of housing 2 of flashlight 1 interacts with inner sliding member 13A by magnetic attraction, housing 2 has no, and need not have, perforations for elements providing physical communication between button 17 and inner sliding member 13A. When the provision of perforations is avoided, intrusion of damaging elements such as water, salt, mud, etc., into housing 2 of flashlight 1 is eliminated.

As button 17 and at least a part of inner sliding member 13A are each a magnet or consist of a magnet or otherwise a magnetisable material being characteristic of a magnet according to the teachings of invention, it is possible to move light source 11 back and forth relatively to lens 8 by sliding button 11 back and forth. In an alternative embodiment, not only is it possible to cause light source 11 to reciprocate back and forth relative to lens 8 by imparting reciprocal movement to sliding button 11, but light source 11 is rotated by causing rotation of sliding button 11 about an circumference of the flashlight body 5. Rotational movement of the sliding button 11 causes inner sliding member 13A to rotate in a similar manner relative to the flashlight body 5. This cause light support 12, and, hence, light source 11 to rotate.

The magnetic communication between button 17 and light support 12 enables a flashlight wherein the focusing assembly does not compromise the resistance of flashlight 1 against e.g. fluids or dust as no openings in housing 2 of flashlight 1 for communication between button 17 and inner sliding member 13A are required. Embodiments with a magnetic button 17 are sturdy, durable and efficient alternatives to known focusing mechanisms where vulnerable seals may be required when the focus is achieved by movement of the head of the flashlight, if the flashlight is to be waterproof.

Slide assemblies 14A and 14B guide sliding members 13A and 13B and provide the stability of the focusing assembly and ensures a smooth change in focus of the light generated by light source 11. Inner sliding members 13A and 13B and hereby light source 11 are guided by slide assemblies 14A and 14B in its back-and-forth motion as button 17 is moved back-and-forwards to change the focus of flashlight 1.

Preferably, housing 1 and lens 8 are arranged to together form a waterproof unit. Such a waterproof unit is possible as lens 8 and housing 2 of flashlight 1 can be fixed relatively to each other as the focus of flashlight 1 is adjusted by movement of light source 11 in the at least partly hollow interior 4 induced by button 17, and this is in contrast to known flashlights where a part of the housing, e.g., a head part containing the lens, is moved relatively to the main body of the flashlight housing.

In advantageous embodiments, flashlight 1 is rechargeable, and waterproofing can be further enhanced since there is no or limited need for easy access to hollow interior 4 of housing 2 of flashlight 1, as required when traditional batteries needing regular change are used. Thus none or a minimum of parts, which may be potentially cause leakage of fluid or dust to hollow interior 4 of flashlight 1, are necessary.

Light source 11 is an LED in a preferred embodiment, as an LED has a very long lifetime and low energy consumption. Due to the long lifetime of an LED, there is no need for frequent access to the part of hollow interior 4 containing light source 11, and thus limited access opening is needed. In an alternate embodiment, light source 11 can be a plurality of LEDs without departing from the invention.

All in all, flashlight 1 which to a very high degree is waterproof is facilitated by the present invention. The magnetic control embodiment of the focusing assembly requires no openings in housing 2 of flashlight 1 to facilitate the communication between button 17 and inner sliding member 13A. Because access light source 11 and/or energy storage (such as battery 10) in hollow interior 4 of housing 2 is only rarely required, such access may be through specialized openings. Such specialized openings can be equipped with or form highly efficient seals. In some embodiments, parts which may form or provide the waterproofing of flashlight 1 may be arranged to be opened by trained persons and/or specialized tools only, in order to keep the waterproofing at a maximum at all times.

Thus according to the present invention, flashlight 1 which is efficiently waterproofed is provided and therefore flashlight 1 may advantageously be used as a diving light.

Flashlight 1 can also be used in other challenging situations where its excellent durability and sturdiness is an advantage. This may be in environments with mud, sand, salt, oil, etc., where the advantageous focusing assembly can ensure that the focus function of flashlight 1 may be maintained at all times as it may be easy to clean. Furthermore, magnet or magnetisable button 17 in magnetic communication with inner sliding member 13A provides ability to change focus of flashlight 1 without jeopardizing the waterproofing of flashlight 1.

Preferably, light source 11 is connected to an energy source arranged in hollow interior 4 with a flexible connection, namely, connector 18. Connector 18 provides the energy supply to light source 11 and is electrically connected between light source 11 and the energy source, namely, battery 10. Battery 10 is housed in the interior of housing 2 of flashlight 1 and only light source 11 with light source support 12 is moved to change the focus of flashlight 1 in response to the movement of button 17.

The flexible connection formed by connector 18 can e.g. be a spring, a soft and flexible wire or a moveable pin which allows the back and forth movement of light source 11. In a preferred embodiment, connector 18 is a soft and flexible and durable wire that provides a constant connection without the application of the force e.g. a spring may provide on the movement of light source 11. A soft wire forming connector 18 is preferably strong and of a material which does not get weakened by the back and forth movement of the light source and such soft wires are well-known to those skilled in the art and such electrical wires and are readily available.

A spring can be used advantageously if e.g. the most frequently used focus of flashlight 1 is achieved with light source 11 in its position where it is closest to lens 8. In this case, the focus may be changed from said frequently used focus, which is an unforced position (the spring is relaxed), by sliding button 17 and hereby inner sliding member 13A and light source 11 and light source support 12 in the direction away from lens 8 by application of a force strong enough to compress the spring until the needed focus is achieved. When the force on button 17 is released, light source 11 and hereby also light source support 12 and button 17 may be returned to the unforced position closest to lens 8 by the force of the compressed spring. The spring may be soft so that only a slight force is needed to compress it and that the movement back to the unforced position is slow and soft. The spring may also e.g. be harder requiring a stronger force and providing a fast repositioning to the unforced position. The spring can also e.g. be configured to that the relaxed state is achieved with light source 11 in its position where it is furthest away from lens 8.

A preferred lens 8 used in flashlight 1 according to the present invention may e.g. be various collimator lenses, "half moon" lenses, or can be designed according to the specific LED light source model as well as the specific output modes that needs to be achieved with each flashlight model.

In alternative embodiments, the button 17 may be replaced by an alternative external light source motion controlling mechanism, such as, but not limited to the focusing rings 102, 202 shown and described with respect to FIGS. 7-10 below.

Figure 7:
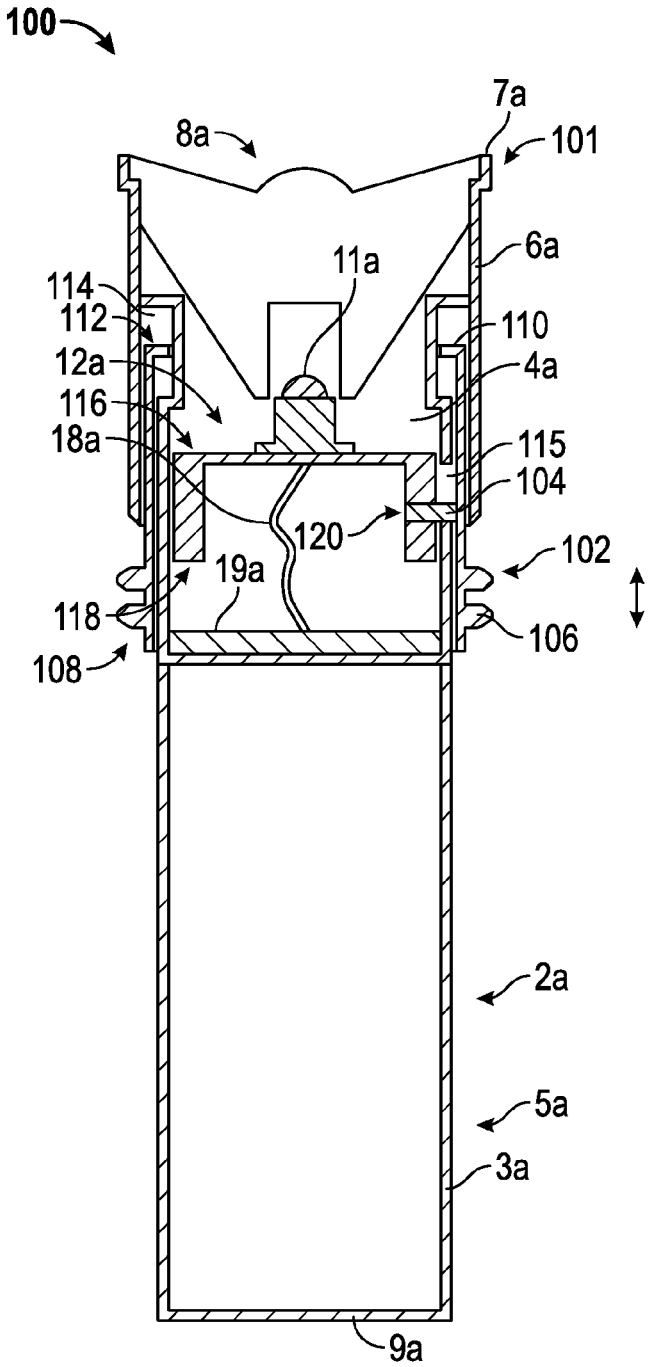
FIG. 7 is a cross-sectional view of another embodiment of a focusing assembly for a flashlight.
Figure 8:
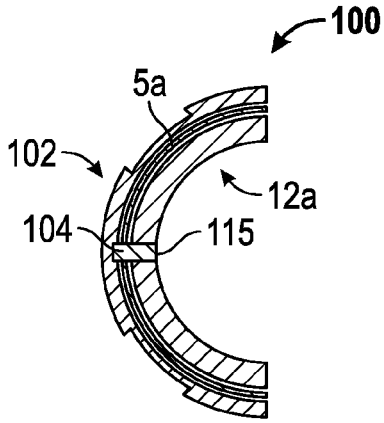
FIG. 8 is a partial cross-sectional view of the focusing assembly of FIG. 7.

With reference to FIGS. 7 and 8, another embodiment of a focusing assembly 100 of a flashlight 101 will be described. Similar elements to those shown and described above with respect to FIGS. 1-6 will be shown and/or described with like reference numbers, but with an "a" suffix, and the subject matter described with respect to the other figures in the present application is incorporated herein. In the embodiment shown, the optical lens 8*a* is specifically configured to enable the proper light beam for different focusing states of the focusing assembly 100.

The focusing assembly 100 is controlled is a similar manner to that shown and described above with respect to FIGS. 1-6, except the focusing assembly 100 is non-magnetic (i.e., does not include magnetic/magnetizable elements for translating motion of a button on an outside of the flashlight body into motion of a LED within a hollow chamber inside the flashlight body). Instead, the focusing assembly 100 includes a focusing ring 102 directly connected to a light source support 12*a* through a mechanical coupler, arm, or focusing ring connection rod 104.

The focusing ring 102 circumferentially surrounds an outer surface 3*a* of the flashlight body 5*a* and reciprocally and slidably moves in a longitudinal direction of the flashlight 101 in the direction of the arrows shown. The focusing ring 102 is substantially cylindrical and may include one or more protruding segments 106 or other external features in a lower ring portion 108 and include an inwardly extending top end 110 in an upper ring portion 112. The inwardly extending top end 110 is movably disposed within an annular upper ring receiving section 114, which is disposed within hollow interior 4*a*, radially outward from lens 8*a*.

The light source support 12*a* is cup-shaped and includes a flat circular top surface or base 116 that supports the light source (e.g., LED) 11*a* and an annular bottom section or wall 118 includes a side hole 120 that receives the focusing ring connection rod 104. The connection rod 104, which directly connects the external focusing ring 102 to the light source support 12*a*, reciprocally slides within a groove 115 of the body 5*a* to enable the light source support 12*a* to move with movement of the external focusing ring 102.

In use, to adjust the focus of a light beam emitted from the flashlight 101, the focusing ring 102 is reciprocally moved, without rotation, along the longitudinal direction of the body in the direction of the arrows. Because the light source support 12*a* is directly coupled to the external focusing ring 102, movement of the focusing ring 102 imparts direct, corresponding movement in the light source support 12*a*. This causes the light source 11*a* to move relative to the lens 8*a*. Because the optical lens 8*a* is specifically configured to provided different light beam focusing states for different positions of the light source 11*a* relative to the optical lens 8*a*, the reciprocal movement of the external focusing ring 102 causes different light beam focusing states (e.g., a first brighter narrow light beam focusing state with the light source 11*a* at a mouth of frustoconical hole 124 of lens 8*a*, a second broader light beam focusing state with the light source 11*a* disposed further within frustoconical hole 124). Thus, movement of the external focusing ring 102 towards first end 7*a* causes a broader light beam and movement of the external focusing ring towards the second end 9*a* causes a narrower, brighter light beam.

Figure 9:
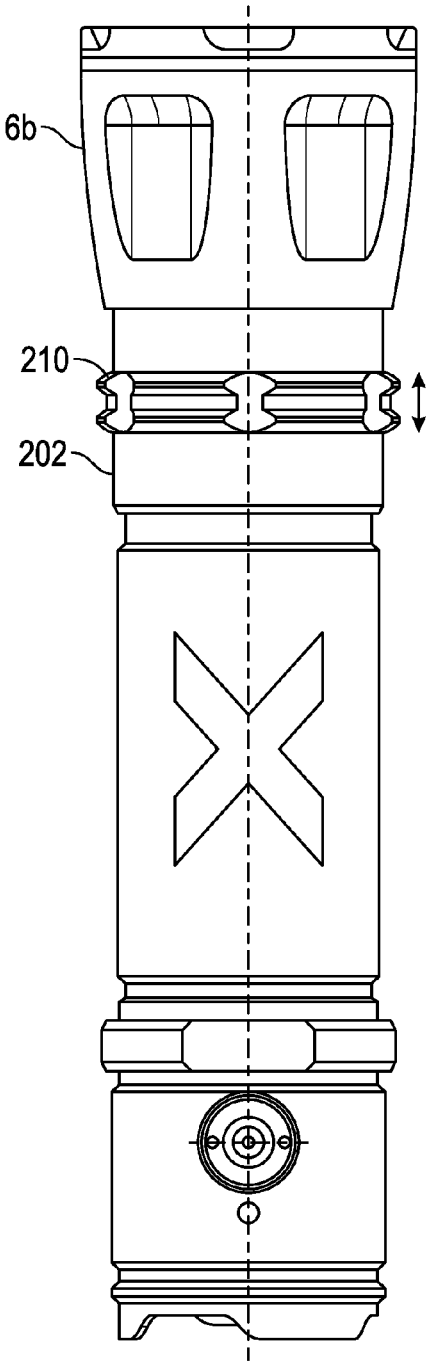
FIG. 9 is a side elevational view of another embodiment of a focusing assembly for a flashlight.
Figure 10:
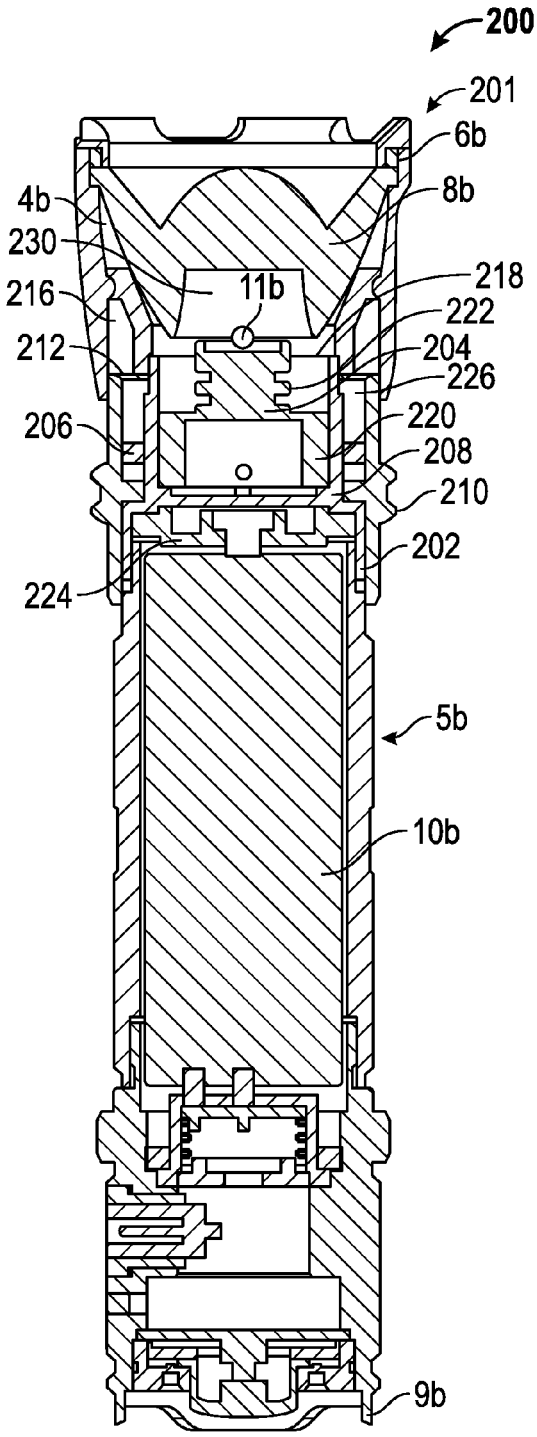
FIG. 10 is a cross-sectional view of the focusing assembly and flashlight of FIG. 9.

With reference to FIGS. 9 and 10, a further embodiment of a focusing assembly 200 of a flashlight 201 will be described. Similar elements to those shown and described above with respect to FIGS. 1-6 will be shown and/or described with like reference numbers, but with a "b" suffix, and the subject matter described with respect to the other figures in the present application is incorporated herein. Similar to the lens 8*a*, the optical lens 8*b* is specifically configured to enable the proper light beam for different focusing states of the focusing assembly 200.

Similar to the focusing assembly 100 of FIGS. 7 and 8, the focusing assembly 200 includes an external focusing ring 202 directly connected to a light source support or mounting assembly 204 through a mechanical coupler or connection rod 206 for reciprocal movement therewith relative to lens 8*b* and flashlight body 5*b*.

The external focusing ring 202 circumferentially surrounds a mounting assembly guide rail 208 and reciprocally and slidably moves in a longitudinal direction of the flashlight 201 in the direction of the arrows shown to move the light source support 204. The focusing ring 202 is substantially cylindrical and may include one or more protruding segments 210 or other external features extending from an exterior or focusing ring 202. The focusing ring 202 includes an inwardly extending top end 212 in an upper ring portion 214. The inwardly extending top end 212 is movably disposed within an annular upper ring receiving section 216, which is disposed within hollow interior 4*b*, radially outward from lens 8*b*.

The light source support/mounting assembly 204 acts as a vehicle to move the light source (e.g., LED) 11*a* to different focusing positions and also act as heat sink to keep excessive heat away from the light source 11*a*. The light source support 12*b* has a cup-shaped configuration with an upper portion 218 and an annular lower portion 220. The upper portion 218 includes one or more spaced annular, radially outward protruding cooling fins or ribs 222 (is this correct?) to draw heat away from the light source 11*a* and a circular recess that receives the light source (e.g., LED) 11*b*. The lower portion 220 of the light source support 12*b* houses one or more electrical connectors or other electronics for electrically coupling the light source 11*b* to battery 10*b* via PCB board assembly 224 and a flexible connector (Is this shown?). The PCB board assembly 224 connects the light source 11*b* to the battery 10*b* as well as enabling various flashlight functions.

The mounting assembly guide rail 208 allows the light source support 204 to move reciprocally in the longitudinal direction of the flashlight 201 (without rotation of the light source support 204) in a stable trajectory and acts as framework to keep all parts of the flashlight head together. The connection rod 206, which directly connects the external focusing ring 202 to the light source support 204, reciprocally slides within a groove 26

In the mounting assembly guide rail 208 to enable the light source support 204 to move with movement of the external focusing ring 202. The connection rod 206 spans the groove 226 between an inner wall of the focusing ring 202 and an outer surface of the mounting assembly guide rail 208. Not only does the connection rod 206 connect the external focus ring 202 with the light source support 204, but because it is thermally coupled to thermally conductive light source support 204, the connection rod 206 also transfers heat from an inner part of the focusing assembly 200 to an outer part of the focusing assembly 200 and outside the body 5*b*.

In use, to adjust the focus of a light beam emitted from the flashlight 201, the focusing ring 202 is reciprocally moved, without rotation, along the longitudinal direction of the body in the direction of the arrows. Because the light source support 226 is directly coupled to the external focusing ring 202, movement of the focusing ring 202 imparts direct, corresponding movement in the light source support 226. This causes the light source 11*b* to move relative to the lens 8*b*. Reciprocal movement of the external focusing ring 102 causes different light beam focusing states: a first brighter narrow light beam focusing state with the light source 11*b* at a mouth of frustoconical hole 230, and a second broader light beam focusing state with the light source 11*b* disposed further within frustoconical hole 230. Thus, movement of the external focusing ring 202 towards first end 7*b* causes a broader light beam and movement of the external focusing ring towards the second end 9*b* causes a narrower, brighter light beam.

The invention has been described above with reference to preferred embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A flashlight comprising:

a housing including a hollow interior bound by a chamber wall having opposed inner and outer surfaces;

a lens carried by the housing opposing the hollow interior;

a light source comprising at least one light emitting diode supported by a movable light source support in the hollow interior; and a focusing assembly for moving the light source relative to the lens in a longitudinal motion comprising: an external moveable element movably arranged on the outer surface of the chamber wall; and a mechanical connector coupling the external moveable element with the light source support for movement of the light source support in the hollow interior along the inner surface of the chamber wall, by the external moveable element, the mechanical connector and the external movable element defining a heat transfer mechanism for transferring heat away from the light source and the moveable light source support.

2. The flashlight according to claim 1, wherein the mechanical connector is a connection rod.

3. The flashlight according to claim 1, wherein the external movable element is an external focusing ring movably arranged on the outer surface of the chamber wall.

4. The flashlight according to claim 3, wherein the external focusing ring includes a top end and the flashlight includes an annular receiving section in the hollow interior and disposed radially outward from the lens, and the top end of the external focusing ring is movably disposed in the annular receiving section.

5. The flashlight according to claim 1, wherein the lens includes a rear hole, and the focusing assembly moves the light source within the rear hole of the lens in a longitudinal motion.

6. The flashlight according to claim 5, wherein the rear hole of the lens includes a frustoconical configuration.

7. The flashlight according to claim 1, wherein the flashlight includes a groove that the mechanical connector reciprocally slides within to enable the light source support to move with movement of the external movable element.

8. The flashlight according to claim 1, wherein the light source includes an energy source carried by the housing and light source is coupled to the energy source with a flexible connection that yields between the energy source and the light source support in response to movement of the light source support with the focusing assembly.

9. The flashlight according to claim 8, wherein the flexible connection is a flexible wire.

* * * * *